US005104730A

United States Patent [19]

Misuda et al.

[11] Patent Number: 5,104,730

[45] Date of Patent: Apr. 14, 1992

[54] RECORDING SHEET

[75] Inventors: Katsutoshi Misuda, Yokohama; Hitoshi Kijimuta, Ebina; Takafumi Hasegawa, Yokohama, all of Japan

[73] Assignee: Asahi Glass Company Ltd., Tokyo, Japan

[21] Appl. No.: 528,617

[22] Filed: May 25, 1990

[30] Foreign Application Priority Data

Jul. 14, 1989 [JP] Japan ..... 1-180561
Oct. 31, 1989 [JP] Japan ..... 1-281997
Mar. 30, 1990 [JP] Japan ..... 2-81323

[51] Int. Cl.[5] ..... B41M 5/00

[52] U.S. Cl. ..... 428/304.4; 346/135.1; 428/195; 428/331; 428/336; 428/454; 428/520; 428/914

[58] Field of Search ..... 346/135.1; 428/195, 428/304.4, 454, 914, 331, 336, 520

[56] References Cited

FOREIGN PATENT DOCUMENTS 298424 1/1989 European Pat. Off. ..... 428/195
60-245588 12/1985 Japan ..... 428/195

*Primary Examiner*—Pamela R. Schwartz
*Attorney, Agent, or Firm*—Oblon, Spivak, McClelland, Maier & Neustadt

[57] ABSTRACT

A recording sheet comprising a substrate and a porous layer of ink absorbent formed thereon, wherein the porous layer of ink absorbent is made mainly of pseudo-boehmite.

28 Claims, No Drawings

RECORDING SHEET

The present invention relates to a recording sheet. Particularly, it relates to a recording sheet which is recordable with either water-base ink or oil-base ink, to which various printing methods may be applied and on which clear records may be made.

In recent years, there have been many opportunities in which overhead projectors are employed instead of conventional slide projectors, for presentation at meetings of various academic societies or at various other meetings. Further, in the field of printing, transparent printed matters are required for various publications, packaging, etc.

In writing or printing on such transparent sheets, special caution or care is required particularly for the printing speed or drying, as compared with printing on usual paper sheets, since the transparent sheets lack in ink absorptivity. Also with opaque substrates, ink absorptivity is poor, and similar caution or care is required in many cases.

Further, in order to obtain a small quantity of printed matters such as sheets for overhead projectors, it has been common to adopt a method wherein manuscripts are prepared by means of a personal computer or a word processor and printed out by a printer. As such a printer, an ink jet system is regarded as prospective since full coloring is thereby easy, and an ink jet recording medium having porous alumina xerogel with pores having a radius of from 40 to 1,000 Å in the layer of ink absorbent, is known (Japanese Unexamined Patent Publication No. 245588/1985).

On the other hand, there is offset printing which provides a high resolution and whereby a high quality image can be obtained. In the offset printing, an ink obtained by kneading a pigment and an oil-type vehicle such as an unsaturated carboxylic acid glyceride, is printed together with damping water via a printing roller, a rubber roller and an impression cylinder.

However, recording sheets for these various printing methods are not yet fully satisfactory. For example, application of the ink jet system to transparent sheets is limited to a case where printing may be of a poor quality, since a large amount of ink is used and the transparent sheets have poor absorptivity, and full coloring is almost impossible.

In the case of printing on opaque sheets of e.g. paper, many printing methods have difficulties in providing clear colorful printing with gloss.

In the ink jet recording medium disclosed in Japanese Unexamined Patent Publication No. 245588/1985, alumina xerogel is employed as a layer of ink absorbent, whereby the particle size is relatively large, and accordingly, the clearances among the particles are also large. As a result, it has a drawback that scattering of light will result, the transparency will be impaired, and the printed image tends to be whitened. And, this tendency is remarkable especially when the substrate is made of a transparent material.

In the case of offset printing, if the surface to be printed is of poor absorptivity, such as a glass or plastic surface, the printing performance is low, and it takes time for drying the ink, whereby it is hardly practically useful. In such a case, screen printing or gravure printing is employed instead of the offset printing.

However, the screen printing also has a drawback that it takes time for drying the ink.

The present inventors have conducted extensive researches to overcome the above mentioned various drawbacks of the conventional methods and to obtain a recording sheet which is capable of providing sufficient full-color development even on a substrate having poor ink absorptivity and which does not lose transparency even when printing is applied on a transparent substrate. As a result, they have found that the above object can be accomplished by using pseudo-boehmite as a layer of ink absorbent on a substrate sheet.

Thus, the present invention provides a recording sheet comprising a substrate and a porous layer of ink absorbent formed thereon, wherein the porous layer of ink absorbent is made mainly of pseudo-boehmite.

Now, the present invention will be described in detail with reference to the preferred embodiments.

As the substrate to be used in the present invention, organic films or sheets made of e.g. polyethylene terephthalate, polyester or diacetate, transparent materials such as various glass materials, opaque materials such as metals or papers, or translucent materials such as fluorine resin films made of e.g. an ethylene-tetrafluoroethylene copolymer, may optionally be employed. The present invention is effective particularly for plastic substrates having low ink absorptivity, and it is particularly suitable for transparent plastic substrates.

The thickness of the substrate is selected depending upon the particular purpose and is not particularly limited. To improve the adhesion with the after-mentioned layer of ink absorbent, the substrate may preliminarily be subjected to surface treatment such as corona discharge treatment, or may be provided with a precoat layer.

As the ink absorbent in the present invention, pseudo boehmite is employed. Here, the pseudo-boehmite is agglomerate of colloidal fine particles having a chemical composition of AlO(OH).

As such pseudo-boehmite, the one having an adsorptivity of from 20 to 100 mg/g is preferred. For the purpose of the present invention, the adsorptivity is defined as follows.

One g of pseudo-boehmite pulverized to an average particle size of 15 μm is put into 100 cc of water at room temperature (25° C.), and an aqueous solution containing 2% by weight of Food Black 2 is dropwise added at a rate of 1 cc/min under stirring, whereby the adsorptivity is represented by the dyestuff solid content (mg/g) adsorbed to the powder by the time when the liquid starts to be colored.

If the adsorptivity of the pseudo-boehmite departs from the above range, no adequate color development or resolution is likely to be obtained.

For the pseudo-boehmite layer as the layer of ink absorbent, it is preferred that the pore radius of pores in the layer is not larger than 100 Å, and it does not substantially contain pores with a radius exceeding 100 Å. Specifically, it is preferred that the pore volume of pores with a radius of from 100 to 300 Å is not larger than 0.1 cc/g.

If the pore radius exceeds 100 Å, scattering of light will result, the transparency will be impaired, or the image tends to be whitened, such being undesirable.

To satisfy both the transparency and the ink absorptivity, it is preferred that the pore volume of pores with a radius of not larger than 100 Å, is at least 70% of the total pore volume. More preferably, it is at least 90%.

When the pseudo-boehmite is used as the layer of ink absorbent, the physical properties of the pseudo-boehmite layer to be formed, vary more or less by the printing method to be employed for printing thereon.

For the pseudo-boehmite layer to be commonly employed for many printing methods, it is preferred that the total volume of pores with a pore radius of from 10 to 100 Å, is from 0.3 to 1.0 cc/g. The printing methods include, for example, offset printing, screen printing, gravure printing, letterpress printing, thermal transfer printing, dot impact printing and electrostatic electrophotography. The recording sheet of the present invention is also suitable for hand writing.

It is particularly preferred to employ a pseudo-boehmite layer wherein the average pore radius is within a range of form 15 to 30 Å, and pores with a radius within the range of ±10 Å of the average pore radius constitute at least 55% of the total pore volume.

Such a pseudo-boehmite layer is formed on a suitable substrate which may be transparent, opaque or translucent.

When a transparent substrate is employed, if the above pore radius and the pore volume depart from the above ranges, haze will result, whereby the significance of using a transparent substrate will be lost, and clearness of the colors will be impaired.

When an opaque substrate or a translucent substrate is employed, if the pore radius and the pore volume depart form the above ranges, it is likely that clear images with gloss are hardly obtainable.

In a case where the printing method employs an ink containing a relatively large amount of a solvent as in the case of an ink jet printer, it is preferred to employ a pseudo-boehmite layer having the following properties, whether the substrate used for forming the layer of ink absorbent, is transparent, opaque or translucent.

Namely, the total volume of pores with a radius of from 10 to 100 Å, is from 0.5 to 1.0 cc/g.

If the radius and the total volume depart from the above range, scattering of light will result, and the printed image tends to be whitened, whereby full coloring will be difficult.

It is particularly preferred to employ a pseudo-boehmite layer wherein the average pore radius is within a range of from 30 to 50 Å, and pores with a radius within a range of ±10 Å of the average pore radius constitute at least 45% of the total pore volume.

In such a case, any color can adequately be developed, and a clear image can be obtained.

In the present invention, the pore size distribution is measured by a nitrogen adsorption and desorption method by means of Omnisorp 100, manufactured by Omicron Technology Co.

The thickness of the above pseudo-boehmite layer is usually from 1 to 20 μm for any printing method.

If the thickness is less than the above range, the color development tends to be inadequate. On the other hand, if the thickness exceeds the above range, the mechanical strength of the layer is likely to deteriorate, or transparency is likely to be impaired.

To form the pseudo-boehmite layer on the substrate, it is common to employ a method wherein a mixture of a boehmite sol and a binder, is coated on the substrate by various coaters such as a roll coater, an air knife coater, a blade coater, a rod coater or a bar coater, followed by drying.

As the binder, it is usually possible to employ an organic material such as starch or its modified products, polyvinyl alcohol (PVA) or its modified products, SBR latex, NBR latex, hydroxycellulose or polyvinylpyrrolidone. Among them, it is preferred to employ PVA, since it is thereby possible to adequately improve the mechanical strength of the layer of ink absorbent without substantially impairing the desired physical properties of the pseudo-boehmite.

If the amount of the binder is too small, the strength of the layer of ink absorbent tends to be inadequate. On the other hand, if it is too large, the absorptivity of the ink will be impaired. Therefore, it is usually preferred to employ a binder in an amount of from 10 to 50% by weight of the pseudo-boehmite.

The surface of the layer of ink absorbent is smooth and flat immediately after being coated on the substrate by means of such coaters. However, during the process of drying, the surface may sometimes turn into an irregular roughened surface. If the layer of ink absorber turns into such a state and printing is applied thereon, the printed image is likely to be whitened and unclear.

In the present invention, this can be prevented by adjusting the ten-point mean roughness of the surface of the layer of ink absorbent to a level of at most 0.05 μm. There, the ten-point mean roughness is the one prescribed in JIS B-0601, and it is determined as follows.

The roughness of the coated surface was observed by means of an electron probe surface analyzer (ESA-3000 manufactured by Elionix Co.) (5,000 magnifications), and from the profile thereby obtained, the ten-point mean roughness was calculated in accordance with JIS B-0601.

There is no particular restriction as to the means to impart the smoothness to the layer of ink absorbent. For example, a suitable means such as a roll press or a flat plate press using a flat plate, may be employed. In practice, to impart smoothness to the surface of the layer of ink absorbent, the roll pressing or the flat plate pressing is applied after or immediately before drying the layer of ink absorbent. The pressure to be applied for this purpose is usually at a level of a linear pressure of from 10 to 40 kg/cm. If the pressing pressure is too low, a smooth surface can not be obtained. On the other hand, if the pressure is too high, pores will be closed, such being undesirable.

The recording sheet of present invention is recordable with either water-base ink or oil-base ink, by either printing or hand-writing. The sheet thus obtained has uniform printing and antistatic property.

From a further study of the present invention, in a case where the above mentioned printing method employs an ink containing a solvent in a relatively large amount as in the case of the ink jet printer, if the ink is fully absorbed in the layer of ink absorbent, the color development will be hindered due to the large amount of the solvent.

To overcome such a problem, in the present invention, a layer of fine silica powder is formed on the above pseudo-boehmite layer. In such a case, the printed ink reaches the silica layer first, and only the solvent is held there, so that only the colorant will pass through the silica layer and will be held in the pseudo-boehmite layer. By removing the silica layer thereafter, a clear image with a high color density will be obtained.

As the silica fine powder to be used, it is preferred to employ a powder having an average particle diameter of from 1 to 50 μm and a pore volume of from 0.5 to 3.0 cc/g.

If the average particle size and the pore volume are less than the above ranges, the absorptivity of the solvent tends to be inadequate. On the other hand, if they exceed the above ranges, the absorptivity will be too high, and the colorant will also be held by the silica layer, such being undesirable.

The thickness of the fine silica powder layer is usually from 5 to 50 μm. If the thickness is less than this range, the absorptivity of the solvent will be inadequate, whereby the image tends to run. On the other hand, if the thickness exceeds the above range, the absorptivity of the solvent will be too high, and the colorant will also be held in the silica layer, whereby the image will not adequately be formed.

As the means to provide the fine silica powder layer on the pseudo-boehmite layer, the above mentioned means for forming the pseudo-boehmite layer can likewise be employed.

As the means to remove the silica layer, a method of abrading off, a method of peeling in a sheet form, or a method of washing with water, may be employed.

For the operation of removing the silica layer after printing, a certain care should be paid to the proportions of the binders contained in the respective layers. Namely, in the pseudo-boehmite layer, the weight ratio of the pseudo-boehmite to the binder is preferably within a range of 1:1 to 10:1. If the amount of pseudo-boehmite exceeds this range, it will be likely that also the pseudo-boehmite layer is removed at the time of removing the silica layer. On the other hand, if it is less than this range, the adsorptivity of the dyestuff tends to be low.

In the silica layer, the weight ratio of silica to the binder is preferably within a range of 5:1 to 30:1. If the amount of silica exceeds the above ratio, the silica tends to readily fall off, which is likely to cause clogging of the supply nozzle for printing ink. On the other hand, if it is less than this range, the layer tends to be so strong that it will be difficult to remove it.

Now, the present invention will be described in further detail with reference to Examples and Comparative Examples. However, it should be understood that the present invention is by no means restricted by such specific Examples.

EXAMPLES

The evaluation of the recording sheets obtained in the following Examples and Comparative Examples was conducted by the following methods.

(1) Printing: A black color pattern of 1 cm × 1 cm was printed by means of a color image jet printer IO-735, manufactured by Sharp Co.

(2) Color density: The sheet printed in (1) was placed on a white paper as a backing sheet, and the reflected color density of the black color pattern was measured by Sakura Densitometer PDA45, manufactured by Konishiroku Photo Inc. Co., Ltd.

(3) Resolution: This was evaluated by four ratings from the degree of running of the pattern on the sheet printed in (1). (0: worst, 3: best)

(4) Haze: In accordance with JIS K-7105

Further, in the following, "parts" and "%" mean "parts by weight" and "% by weight", respectively.

EXAMPLE 1

A coating mixture with a solid content of about 10% comprising 5 parts (solid content) of Cataloid AS-3 (manufactured by Catalysts & Chemicals Ind. Co., Ltd.) which is a boehmite sol having an adsorptivity of 80 mg/g, 1 part (solid content) of polyvinyl alcohol PVA117 (manufactured by Kuraray Co., Ltd.) and water, was prepared. This coating mixture was coated on a polyethylene terephthalate film (100 μm, manufactured by Toray Industries, Inc.) by a bar coater so that the film thickness would be 5 μm when dried, followed by drying to obtain a recording sheet.

COMPARATIVE EXAMPLE 1

A sheet was prepared in the same manner as in Example 1 except that Alumina sol 100 (manufactured by Nissan Chemical Ind., Ltd.) which is an amorphous alumina sol, was used instead of AS-3.

COMPARATIVE EXAMPLE 2

A sheet was prepared in the same manner as in Example 1 except that Cataloid SI-40 (manufactured by Catalysts & Chemicals Ind. Co., Ltd.) which is silica sol, was used instead of AS-3.

The physical properties and the evaluation results of the layer of ink adsorbent in each of these sheets, are shown in Table 1. In the Table, "Volume of ±10 Å of average" is the ratio of the volume of pores with a radius within a range of ±10 Å of the average pore radius to the total pore volume.

TABLE 1

| | Porous material constituting the layer of ink absorbent | Physical properties of the layer of ink absorbent: Volume of pores of 10–100 Å cc/g | Volume of pores of 100–300 Å cc/g | Average pore radius Å | Volume of ±10 Å of average % | Evaluation: Color density | Resolution | Haze |
|---|---|---|---|---|---|---|---|---|
| Example 1 | Pseudo-boehmite | 0.83 | 0.02 | 33 | 62 | 1.19 | 3 | 9.5 |
| Comparative Example 1 | Alumina hyderate (amorphous) | 0.06 | 0.03 | 20 | 50 | 1.03 | 0 | 9.7 |
| Comparative Example 2 | Silica | 0.07 | 0.15 | 15 | 57 | 0.80 | 1 | 28.3 |

EXAMPLE 2

Using the recording sheet prepared in accordance with Example 1, solid printing was conducted with 1 cc of offset ink (NS 93 black, manufactured by Morohoshi Printing Ink Co., Ltd.) by means of a printability tester RI-2 model (manufactured by Akira Seisakusho, Ltd.). Immediately thereafter, a high quality paper was overlaid on the printed surface, and a pressure was exerted by the printability tester, whereupon the color density of the ink transferred to the high quality paper side was measured by a reflection densitometer. (With respect to the measurement results, the smaller the numerical value, the more difficult the transfer and accordingly the better.)

The results are shown in Table 2.

COMPARATIVE EXAMPLE 3

The printing and the measurement of the transfer color density were conducted in the same manner as in Example 2 except that a polyethylene terephthalate film (100 μm, manufactured by Mitsubishi Diafoil Co., Ltd.) with its surface treated by corona discharge treatment was used instead of the recording sheet used in Example 2. The results are shown in Table 2.

COMPARATIVE EXAMPLE 4

The printing and the measurement of the transfer color density were conducted in the same manner as in Example 2 except that a commercially available art paper for printing (160 g/m$^2$) was used instead of the recording sheet used Example 2. The results are shown in Table 2.

TABLE 2

| | Transferred color density |
|---|---|
| Example 2 | 0.10* |
| Comparative Example 3 | 1.15 |
| Comparative Example 4 | 1.01 |

*The color density of the high quality paper itself was 0.10, and therefore no transfer took place.

EXAMPLE 3

A coating mixture with a solid content of about 9% by weight comprising 8 parts (solid content) of a transparent sol obtained by the hydrolysis and peptization of aluminum isopropoxide, 1 part (solid content) of polyvinyl alcohol PVA 117 (manufactured by Kuraray Co., Ltd) and water, was prepared. This coating mixture was coated on a polyethylene terephthalate film (OC-type, thickness: 100 μm, manufactured by Teijin Ltd.) as the substrate by a bar coater so that the film thickness would be 5 μm when dried, followed by drying to obtain a recording sheet.

EXAMPLE 4

A coating mixture comprising 6 parts (solid content) of alumina sol Cataloid AS-2 (manufactured by Catalysts & Chemicals Ind. Co., Ltd.), 1 part (solid content) of polyvinyl alcohol PVA 117 (manufactured by Kuraray Co., Ltd.) and water, was prepared. This coating mixture was coated on a polyethylene terephthalate film (OC-type, thickness: 100 μm, manufactured by Teijin Ltd.) as the substrate by a bar coater so that the film thickness would be 5 μm when dried, followed by drying to obtain a recording sheet.

EXAMPLE 5

A recording sheet was prepared in the same manner as in Example 4 except that a white polyethylene terephthalate film was used as the substrate.

EXAMPLE 6

A recording sheet was prepared in the same manner as in Example 4 except that a commercially available art paper was used as the substrate.

EXAMPLE 7

A recording sheet was prepared in the same manner as in Example 4 except that an ethylene-tetrafluoroethylene copolymer (AFLEX, thickness: 100 μm, manufactured by Asahi Glass Co., Ltd.) with its one side treated by corona discharge treatment was used as the substrate.

EXAMPLE 8

A recording sheet was prepared in the same manner as in Example 4 except that an aluminum foil (thickness: 15 μm, manufactured by Nippon Foil Mfg. Co., Ltd.) was used as the substrate.

With respect to these recording sheets, the same tests as in Example 2 were conducted. The physical properties and the evaluation results of the layer of ink absorbent in each sheet are shown in Table 3.

TABLE 3

| | Porous material constituting the layer of ink absorbent | Physical properties of the layer of ink absorbent: Volume of pores of 10–100 Å cc/g | Volume of pores of 100–300 Å cc/g | Average pore radius Å | Volume of ±10 Å of average % | Evaluation: Color density | Haze |
|---|---|---|---|---|---|---|---|
| Example 3 | Pseudo-boehmite | 0.44 | 0.02 | 18 | 75 | 0.14 | 1.0 |
| Example 4 | Pseudo-boehmite | 0.5 | 0.04 | 21 | 86 | 0.12 | 1.2 |
| Example 5 | Pseudo-boehmite | 0.47 | 0.04 | 22 | 74 | 0.12 | — |
| Example 6 | Pseudo-boehmite | 0.47 | 0.04 | 21 | 78 | 0.11 | — |
| Example 7 | Pseudo-boehmite | 0.48 | 0.04 | 20 | 80 | 0.11 | — |
| Example 8 | Pseudo-boehmite | 0.49 | 0.04 | 22 | 78 | 0.12 | — |

EXAMPLE 9

A recording sheet was prepared in the same manner as in Example 4 except that a soda lime glass sheet (thickness: 2 mm) was used as the substrate. A test pattern was printed by a screen printing machine (manufactured by Svecia Co.), whereupon the ink was immediately absorbed and completely set.

Whereas, when the same printing test was conducted with respect to the soda lime glass sheet used as the substrate, at least 10 minutes were required for setting at room temperature.

What is claimed is:

1. A recording sheet comprising a substrate and a porous layer of ink absorbent formed directly upon said substrate, wherein the porous layer of ink absorbent consists essentially of pseudo-boehmite and a binder, said porous layer having a volume of pores with a pore radius exceeding 100 Å at not larger than 0.1 cc/g.

2. The recording sheet according to claim 1, wherein the binder is polyvinyl alcohol.

3. The recording sheet according to claim 1, wherein the binder is in an amount of from 10 to 50% by weight of the pseudo-boehmite.

4. The recording sheet according to claim 1, wherein the porous layer of ink absorbent has a thickness of from 1 to 20 μm.

5. The recording sheet according to claim 1, wherein the pseudo-boehmite has an adsorptivity of from 20 to 100 mg/g.

6. The recording sheet according to claim 1, wherein the pore volume of pores having a radius of not larger than 100 Å, is at least 70% of the total pore volume.

7. The recording sheet according to claim 1, wherein the total volume of pores with a pore radius of from 10 to 100 Å in the layer of ink absorbent is from 0.3 to 1.0 cc/g.

8. The recording sheet according to claim 7, wherein the average pore radius of the layer of ink absorbent is from 15 to 30 Å, and the volume of pores with a radius within a range of ±10 Å of the average pore radius, is at least 55% of the total pore volume.

9. The recording sheet according to claim 7, wherein the average pore radius in the layer of ink absorbent is from 30 to 50 Å, and the volume of pores with a radius within a range of ±10 Å of the average pore radius, is at least 45% of the total pore volume.

10. The recording sheet according to claim 1, wherein the substrate is a plastic.

11. The recording sheet according to claim 10, wherein the substrate is transparent.

12. The recording sheet according to claim 1, which is a recording sheet for an ink jet printer.

13. The recording sheet according to claim 1, wherein the surface of the layer of ink absorbent has a ten-point mean roughness of not more than 0.05 μm.

14. A recording sheet comprising a substrate and a layer of ink absorbent formed directly upon said substrate, wherein the layer of ink absorbent has a double layer structure comprising a layer consisting essentially of pseudo-boehmite and a binder, and a layer thereover consisting essentially of fine silica powder.

15. The recording sheet according to claim 14, wherein the fine silica powder layer is designed to be peeled off after printing by an ink jet printer.

16. The recording sheet according to claim 14, wherein the layer consisting essentially of pseudo-boehmite and binder is a porous layer having a volume of pores with a pore radius exceeding 100 Å at not larger than 0.1 cc/g.

17. The recording sheet according to claim 16, wherein the pore volume of pores having a radius of not larger than 100 Å, is at least 70% of the total pore volume.

18. The recording sheet according to claim 16, wherein the total volume of pores with a pore radius of from 10 to 100 Å in the layer of ink absorbent is from 0.3 to 1.0 cc/g.

19. The recording sheet according to claim 18, wherein the average pore radius of the layer of ink absorbent is from 15 to 30 Å, and the volume of pores with a radius within a range of ±10 Å of the average pore radius, is at least 55% of the total pore volume.

20. The recording sheet according to claim 18, wherein the average pore radius in the layer of ink absorbent is from 30 to 50 Å, and the volume of pores with a radius within a range of ±10 Å of the average pore radius, is at least 45% of the total pore volume.

21. The recording sheet according to claim 14, wherein the layer consisting essentially of pseudo-boehmite and binder is a porous layer having a thickness of from 1 to 20 μm.

22. The recording sheet according to claim 14, wherein the binder is polyvinyl alcohol.

23. The recording sheet according to claim 14, wherein the binder is in an amount of from 10 to 50% by weight of the pseudo-boehmite.

24. The recording sheet according to claim 14, wherein the pseudo-boehmite has an adsorptivity of from 20 to 100 mg/g.

25. The recording sheet according to claim 14, wherein the substrate is a plastic.

26. The recording sheet according to claim 25, wherein the substrate is transparent.

27. The recording sheet according to claim 14, which is a recording sheet for an ink jet printer.

28. The recording sheet according to claim 14, wherein the surface of the layer of ink absorbent has a ten-point mean roughness of not more than 0.05 μm.

* * * * *